US008007316B2

(12) United States Patent
Costello

(10) Patent No.: US 8,007,316 B2
(45) Date of Patent: Aug. 30, 2011

(54) CONTACT ASSEMBLY HAVING AN INTEGRALLY FORMED CAPACITIVE ELEMENT

(75) Inventor: Brian Patrick Costello, Scotts Valley, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 101 days.

(21) Appl. No.: 12/493,898

(22) Filed: Jun. 29, 2009

(65) Prior Publication Data

US 2010/0330851 A1 Dec. 30, 2010

(51) Int. Cl.
*H01R 13/648* (2006.01)

(52) U.S. Cl. ..... 439/607.1; 439/620.09

(58) Field of Classification Search ..... 439/607.1, 439/607.06, 607.11
See application file for complete search history.

(56) References Cited

U.S. PATENT DOCUMENTS

| | | | | |
|---|---|---|---|---|
| 3,721,869 | A | 3/1973 | Paoli | |
| 3,840,841 | A * | 10/1974 | Clark | 439/589 |
| 4,726,790 | A | 2/1988 | Hadjis | |
| 4,792,310 | A * | 12/1988 | Hori et al. | 439/620.1 |
| 4,820,174 | A | 4/1989 | Farrar et al. | |
| 4,929,196 | A | 5/1990 | Ponn et al. | |
| 4,954,794 | A | 9/1990 | Nieman et al. | |
| 5,006,079 | A * | 4/1991 | Okamoto et al. | 439/607.57 |
| 5,586,912 | A | 12/1996 | Eslampour et al. | |
| 5,887,324 | A | 3/1999 | Wu | |
| 6,120,306 | A * | 9/2000 | Evans | 439/101 |
| 2005/0162177 | A1 * | 7/2005 | Chou | 324/754 |
| 2008/0299841 | A1 | 12/2008 | Panella et al. | |

* cited by examiner

*Primary Examiner* — Hien Vu

(57) ABSTRACT

A contact assembly includes a conductive body, a dielectric layer and a conductive layer. The conductive body extends along a longitudinal axis between a mating end and a mounting end. The dielectric layer is disposed over the conductive body between the mating end and the mounting end. The conductive layer is disposed over the dielectric layer and is separated from the conductive body by the dielectric layer. The conductive layer, the dielectric layer, and the conductive body form a capacitive element.

22 Claims, 3 Drawing Sheets

CONTACT ASSEMBLY HAVING AN INTEGRALLY FORMED CAPACITIVE ELEMENT

BACKGROUND OF THE INVENTION

This invention relates generally to contacts used in electrical connectors and, more particularly, to contacts used in conjunction with capacitive filters.

Known electrical connectors are capable of communicating data signals at relatively high rates. The signals are communicated between a connector and another connector and/or a circuit board via one or more contacts. Electrical noise in the signals may increase as the speed at which the signals are communicated increases. In some known connectors, one or more capacitive filters are provided to filter out noise from the signals. For example, some known connectors include one or more capacitors provided in series with contacts to filter out noise in the signals communicated through the contacts. The capacitive filter may be disposed on the circuit board to which the connector is mounted. One or more conductive traces in the circuit board electrically couple the contacts with the capacitive filter. Signals communicated by the connector propagate through the contacts and the capacitive filter via the conductive traces.

Communicating signals through the conductive traces and the capacitive filter increases the total path over which the signals propagate. For example, directing the signals from the contacts and through conductive traces and a capacitive filter before communicating the signals to a final destination adds to the total length over which the signals travel before reaching the destination. Increasing the total length over which the signals travel, that is, the signal path length, may increase the time delay skew in signals communicated through the contacts and capacitive filter. For example, in a connector that communicates differential pair signals over at least two contacts, the additional signal path length that is required to direct the signals through the capacitive filter may increase the time delay skew between the signals.

Additionally, communicating signals through the conductive traces and the capacitive filter may consume more of the already limited real estate on a circuit board. For example, a relatively large number of conductive traces and capacitive filters may be required in a circuit board in order to filter signals communicated using connectors that have several contacts. The large number of conductive traces and capacitive filters may consume a relatively large amount of available area of the circuit board to which the connector is mounted and prevent this area from being used for other connectors or components.

Another drawback for circuit board-mounted capacitors and other components is the need for vias in the circuit board. The vias may include small plated through holes in the circuit board that carry signals between the capacitors or components and conductive traces in the circuit board. For example, vias may carry signals from inside a controlled impedance layer of the circuit board up to the surface of the circuit board, and then back down again into the circuit board. Such a signal propagation path through the circuit board adds discontinuity to the propagation path and may cause signal degradation.

Thus, a need exists for a contact assembly that communicates and filters signals, while minimizing any increases to the signal length, reducing the amount of area that is used on a circuit board to communicate and filter the signals, and/or decreasing discontinuities in signal propagation paths through the circuit board.

BRIEF DESCRIPTION OF THE INVENTION

In one embodiment, a contact assembly is provided. The assembly includes a conductive body, a dielectric layer and a conductive layer. The conductive body extends along a longitudinal axis between a mating end and a mounting end. The dielectric layer is disposed over the conductive body between the mating end and the mounting end. The conductive layer is disposed over the dielectric layer and is separated from the conductive body by the dielectric layer. The conductive layer, the dielectric layer, and the conductive body form a capacitive element. Optionally, the conductive body, the dielectric layer and the conductive layer may form a capacitive filter. In one embodiment, the conductive body provides a signal propagation path between the mating connector and the at least one of the housing connector and the circuit board. The capacitive element may be in series with the signal propagation path.

In another embodiment, another contact assembly is provided. The assembly includes a conductive body, a dielectric layer and a conductive layer. The conductive body is a planar body that extends between opposite ends and includes opposite faces. The dielectric layer is disposed over the faces of the conductive body. The conductive layer is disposed over the faces of the conductive body and over the dielectric layer. The conductive layer is separated from the conductive body by the dielectric layer and is configured to engage a mating contact to provide a signal propagation path between the mating contact and the conductive body. The conductive layer, the dielectric layer, and the conductive body form a capacitive element.

DETAILED DESCRIPTION OF THE INVENTION

Figure 1:
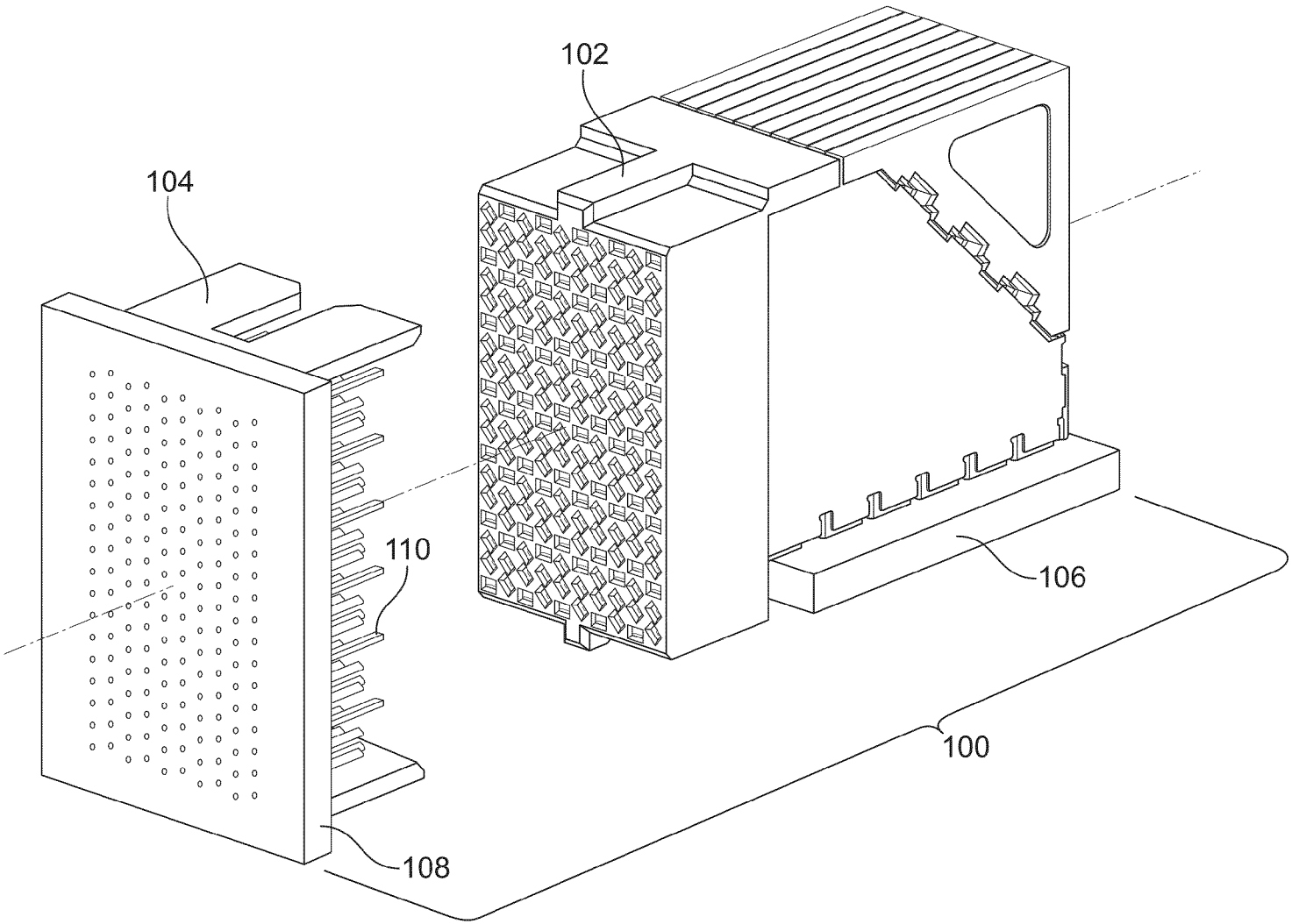
FIG. 1 is a perspective view of a connector system in accordance with one embodiment.

FIG. 1 is a perspective view of a connector system 100 in accordance with one embodiment. The connector system 100 includes two connectors 102, 104 that mate with one another to electrically couple two circuit boards 106, 108. For example, a right angle mating connector 102 is mounted to the circuit board 106 while a mounted connector 104 is mounted to the circuit board 108. The mounted connector 104 includes several contact assemblies 110 that mate with receptacle contacts 300 (shown in FIG. 3) of the mating connector 102 to electrically join the connectors 102, 104. One or more embodiments of the contact assemblies 110 that are described herein may be used with connectors or devices other than those shown in the attached figures. For example, one or more embodiments of the contact assemblies 110 may be used in a system or device having two or more electrical components mated with another to establish a signal propagation path through at least a portion of the two mated components, where a capacitive element is provided in series with the signal propagation path to provide a capacitive filter.

Figure 2:
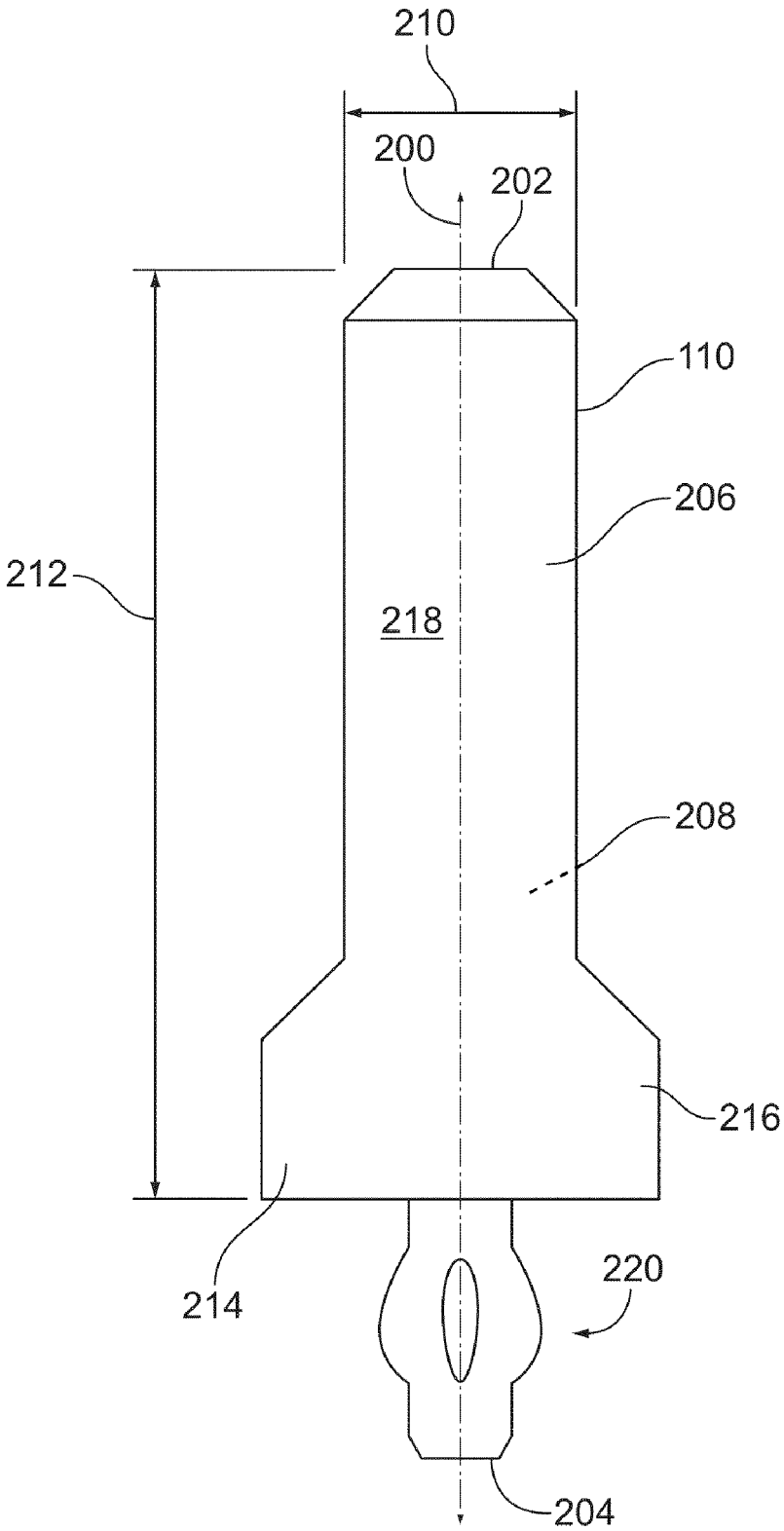
FIG. 2 is an elevational view of a contact assembly shown in FIG. 1 in accordance with one embodiment.

FIG. 2 is an elevational view of the contact assembly 110 in accordance with one embodiment. In the illustrated embodiment, the contact assembly 110 is a contact pin that is received into another contact. Alternatively, the contact assembly 110 may be a receptacle contact that receives another contact. The contact assembly 110 is elongated along a longitudinal axis 200 between a mating end 202 and a mounting end 204. The mating end 202 is received in the receptacle contact 300 (shown in FIG. 3) of the mating connector 102. The mounting end 204 is mounted to the circuit board 108 (shown in FIG. 1). In the illustrated embodiment, the mounting end 204 includes a compliant eye-of-needle (EON) pin 220 that is received in a cavity (not shown) of the circuit board 108 to secure the contact assembly 110 to the circuit board 108.

The contact assembly 110 is a substantially planar body having opposite faces 206, 208 in the illustrated embodiment. Alternatively, the contact assembly 110 may have a different shape. Each of the faces 206, 208 extends over a surface area 218 that has a width dimension 210 and a height dimension 212. The surface area 218 also may include the surface area of shoulders 214, 216 that extend laterally from the longitudinal axis 200 of the contact assembly 110 at or near the mounting end 204. In one embodiment, the surface area 218 of each face 206, 208 may be approximated by multiplying the width dimension 210 by the height dimension 212. The surface area 218 may represent the area of the contact assembly 110 over which data signals are communicated through the contact assembly 110.

Figure 3:
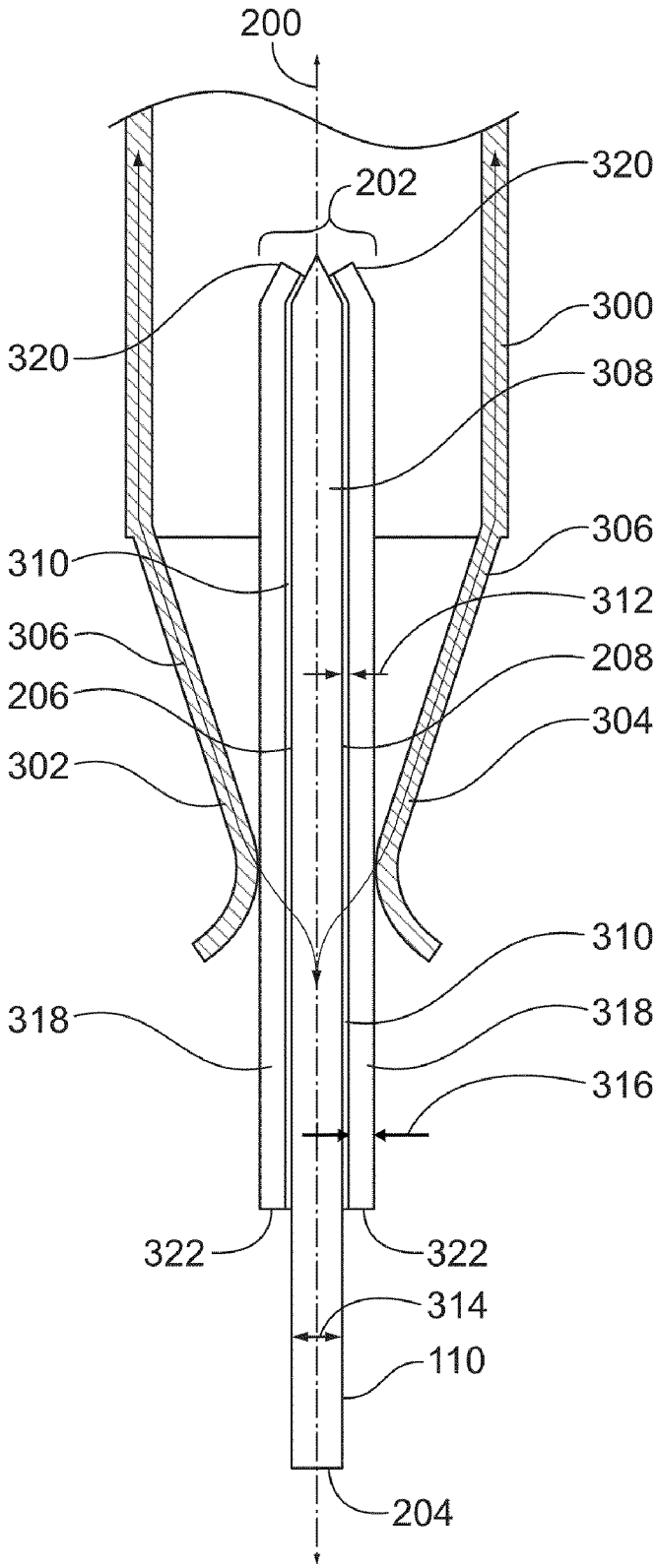
FIG. 3 is a cross-sectional view of the contact assembly shown in FIG. 1 and a receptacle contact in accordance with one embodiment.

FIG. 3 is a cross-sectional view of the contact assembly 110 and the receptacle contact 300 in accordance with one embodiment. The receptacle contact 300 is held by or in the mating connector 102 (shown in FIG. 1). The receptacle contact 300 includes opposing arms 302, 304. The receptacle contact 300 is formed of, or includes, a conductive material, such as a metal or metal alloy. The contact assembly 110 is loaded between the arms 302, 304 to mate and electrically couple the receptacle contact 300 with the contact assembly 110. The mating of the contact assembly 110 and receptacle contact 300 establishes a signal propagation path 306 that extends through at least a portion of each of the contact assembly 110 and the receptacle contact 300. The signal propagation path 306 is schematically illustrated in FIG. 3 and may differ or deviate from the embodiment shown in FIG. 3. The mating connector 102 (shown in FIG. 1) and mounting connector 104 (shown in FIG. 1) may communicate data signals along the signal propagation path 306 between one another.

The contact assembly 110 includes one or more dielectric layers 310 that are sandwiched between conductive bodies or layers. For example, the contact assembly 110 may include a dielectric layer 310 that is between a conductive body 308 and one or more conductive layers 318. The conductive body 308 extends between the mating end 202 and the mounting end 204 along the longitudinal axis 200. The conductive body 308 includes, or is formed from, a conductive material, such as a metal or metal alloy. In one embodiment, the conductive body 308 is formed from a copper alloy. The conductive body 308 is a unitary body in one embodiment. For example, the conductive body 308 may be stamped and formed from a sheet of conductive material. Alternatively, the conductive body 308 may be a molded body. The conductive body 308 provides part of the signal propagation path 306. For example, signals may be communicated between the mating connector 102 (shown in FIG. 1) and the circuit board 108 (shown in FIG. 1) via the conductive body 308.

The contact assembly 110 also includes a dielectric layer 310 over the conductive body 308. The dielectric layer 310 extends over at least a portion of the length of the conductive body 308 between the mating end 202 and the mounting end 204. For example, the dielectric layer 310 may be deposited over the surface area 218 (shown in FIG. 2) of the conductive body 308. In one embodiment, the dielectric layer 310 substantially encloses or surrounds the conductive body 308 between the mating end 202 and the mounting end 204. For example, the conductive body 308 may be coated with the dielectric layer 310 around all or substantially all of the conductive body 308. Alternatively, only a portion of the conductive body 308 is enclosed by the dielectric layer 310. For example, the conductive body 308 may be coated by the dielectric layer 310 from the mating end 202 to a location above the EON pin at the mounting end 204. The dielectric layer 310 may be applied over just the opposite faces 206, 208 of the conductive body 308. For example, the dielectric layer 310 may be deposited only on the faces 206, 208 and not over the mating end 202.

The dielectric layer 310 includes or is formed from, one or more nonconductive or electrically insulative materials. The dielectric layer 310 may include, or be formed from, materials that have a relatively large dielectric constant ($\in$). For example, the dielectric layer 310 may have a dielectric constant or relative static permittivity ($\in$) of about 80 to 150 Farads per meter. In one embodiment, the dielectric layer 310 includes, or is formed from, barium titanate ($BaTiO_3$). Alternatively, the dielectric layer 310 includes, or is formed from, tantalum pentoxide or tantalum oxide ($Ta_2O_5$).

The dielectric layer 310 is provided over the conductive body 308 at a relatively small thickness. For example, the dielectric layer 310 may be deposited in a thickness dimension 312 that is less than a thickness dimension 314 of the conductive body 308 and less than a thickness dimension 316 of one or more of the conductive layers 318. By way of example only, the dielectric layer 310 may be deposited directly onto the conductive body 308 on each of the faces 206, 208 of the conductive body 308 at a thickness dimension 312 of approximately 5 microns or less. As another nonlimiting example, the dielectric layer 310 may be deposited at a thickness dimension 312 of approximately 100 nanometers to approximately 10 microns.

The dielectric layer 310 may be provided over the conductive body 308 by any of a variety of deposition techniques and processes. By way of example only, the dielectric layer 310 may be deposited directly onto the conductive body 308, such as by sputtering the dielectric layer 310 onto the conductive body 308. In another example, the dielectric layer 310 may be deposited onto the conductive body 308 by electrocoating the conductive body 308 with the dielectric layer 310. Alternatively, the dielectric layer 310 may be provided as an adhesive film or tape that is adhered to the exterior surface of the conductive body 308. For example, a tape that includes the dielectric layer 310 may be adhered to the opposite faces 206, 208 of the conductive body 308.

The conductive layer 318 is disposed over the dielectric layer 310. For example, the conductive layer 318 may be deposited onto, or adjacent to, the exterior surface of the dielectric layer 310. The conductive layer 318 is provided above the dielectric layer 310 such that the conductive layer 318 does not directly contact the conductive body 308. For example, the dielectric layer 310 may separate the conductive layer 318 from the conductive body 308 such that there is no direct electrical continuity path extending directly from the conductive layer 318 to the conductive body 308. The conductive layer 318 extends over at least a portion of the length of the dielectric layer 310 and the conductive body 308 between the mating end 202 and the mounting end 204. For example, the conductive layer 318 may be deposited over the surface area 218 (shown in FIG. 2) of the dielectric layer 310 and the conductive body 308. In the illustrated embodiment, the conductive layer 318 is provided as separate layers on opposite sides of the dielectric layer 310. For example, the conductive layer 318 is shown in FIG. 3 as including a layer deposited above the dielectric layer 310 above each of the faces 206, 208 of the conductive body 308. The conductive layer 318 extends between opposite outer ends 320, 322 above each face 206, 208. The outer ends 320 of the conductive layer 318 are located at or near the mating end 202. The outer ends 322 are disposed above the shoulders 214, 216 in the illustrated embodiment. Alternatively, the conductive layer 318 is provided above the dielectric layer 310 such that the conductive layer 318 substantially encloses or surrounds the dielectric layer 310. For example the dielectric layer 310 may be coated with the conductive layer 318 around all or substantially all of the dielectric layer 310.

The conductive layer 318 includes or is formed from, one or more conductive materials. By way of example only, the conductive layer 318 may be a copper alloy that is at least partially plated with gold. Alternatively, a different metal or other conductive material may be used as the conductive layer 318. The conductive layer 318 is deposited at the thickness dimension 316 above the dielectric layer 310. The thickness dimension 316 of the conductive layer 318 may be larger than the thickness dimension 312 of the dielectric layer 310 and smaller than the thickness dimension 314 of the conductive body 308. The conductive layer 318 may be provided by any of a variety of deposition techniques and processes. By way of example only, the conductive layer 318 may be deposited directly onto the dielectric layer 310 by sputtering the conductive layer 318 onto the dielectric layer 310. In another example, the conductive layer 318 may be deposited by electroplating the conductive layer 318 onto the dielectric layer 310. Alternatively, the conductive layer 318 may be provided as a conductive film or tape that is adhered to the exterior surface of the dielectric layer 310.

In another embodiment, the dielectric layer 310 and the conductive layer 318 are provided above the conductive body 308 prior to stamping and forming the contact assembly 110. For example, the dielectric layer 310 and the conductive layer 318 may be deposited on the opposite sides of a conductive sheet. The conductive sheet, the dielectric layers 310 and the conductive layers 318 may be stamped and formed from the conductive sheet to form the contact assembly 110. In such an example, the conductive sheet is stamped and formed into the conductive body 308 shown in FIG. 3.

The conductive body 308, the dielectric layer 310 and the conductive layer 318 form a capacitive element. For example, the dielectric layer 310 separates the conductive body 308 and the conductive layer 318 from one another to form a capacitor. The capacitive element created by the conductive body 308, the dielectric layer 310 and the conductive layer 318 may be a capacitive filter that is integrally formed with the contact assembly 110. For example, the contact assembly 110 shown in FIG. 3 is formed so as to have an inherent electrical capacitive characteristic (C). The contact assembly 110 and capacitive filter formed by the contact assembly 110 may be provided as a unitary body, rather than a capacitive filter that is external to the contact assembly 110 and electrically coupled thereto.

The capacitive element that is formed by the contact assembly 110 is disposed in series with the signal propagation path 306 in the illustrated embodiment. As shown in FIG. 3, the receptacle contact 300 engages the conductive layer 318 of the contact assembly 110 above the opposite faces 206, 208 to electrically couple the receptacle contact 300 and the contact assembly 110. Data signals may be communicated between the receptacle contact 300 and the contact assembly 110 along the signal propagation path 306 such that the signals pass through the capacitive element formed by the contact assembly 110. For example, a data signal that is communicated from the receptacle contact 300 to the contact assembly 110 passes through the arms 302, 304 of the receptacle contact 300 to the conductive layer 318, from the conductive layer 318 to the conductive body 308 by passing across the dielectric layer 310, and from the conductive body 308 to the circuit board 108 (shown in FIG. 1) to which the contact assembly 110 is mounted.

The signals may be filtered by the capacitive element formed by the contact assembly 110. The inherent capacitive properties of the contact assembly 110 permit the contact assembly 110 to both communicate signals and to filter the signals. The contact assembly 110 may filter out noise from relatively high speed signals that are communicated along the signal propagation path 306. By way of example only, the capacitive element may be a high pass filter that filters out signals communicated at a frequency below a cutoff frequency of the contact assembly 110. The contact assembly 110 may permit the signals communicated at frequencies above the cutoff frequency to be communicated along the signal propagation path 306 while preventing signals transmitted at lower frequencies to pass along the signal propagation path 306. In another example, the capacitive element may be a low pass filter that filters out signals communicated at a frequency above a cutoff frequency of the contact assembly 110. The contact assembly 110 may permit the signals communicated at frequencies below the cutoff frequency to be communicated along the signal propagation path 306 while preventing signals transmitted at higher frequencies to pass along the signal propagation path 306. As the capacitive element is integrally formed with the contact assembly 110, the contact assembly 110 may effectively include a capacitive filter without significantly increasing the signal length over which the signals travel along the signal propagation path 306. Therefore, the contact assembly 110 may both communicate and filter signals without significantly impacting the time delay skew in the signals.

An electrical capacitance characteristic (C) of the contact assembly 110 represents an ability of the contact assembly 110 to hold an electric charge. The capacitance characteristic (C) of the contact assembly 110 may be based on a relation with the surface area 218 (shown in FIG. 2) of faces 206, 208 of the contact assembly 110 and the thickness dimension 312 of the dielectric layer 310. For example, the electrical capacitance characteristic (C) of the contact assembly 110 may be based on the relation:

$$C = \varepsilon_d^A \qquad \text{(Eqn. 1)}$$

where C represents the electrical capacitance characteristic of the contact assembly 110, $\in$ represents the dielectric constant of the dielectric layer 310, A represents the surface area of the contact assembly 110 over which the electric potential of signals communicated through the contact assembly 110 extends, and d represents the thickness dimension 312 of the dielectric layer 310. In the embodiment illustrated in FIG. 3, the surface area A of Equation 1 includes the total surface area over which signals are communicated through the contact assembly 110. For example, the surface area A may include the sum total of the surface area 218 of the face 206 and the surface area 218 of the face 208 of the contact assembly 110. As shown in Equation 1, as the surface area 218 of the faces 206, 208 increases and/or the thickness dimension 312 of the dielectric layer 310 decreases, the electrical capacitance characteristic (C) of the contact assembly 110 may increase. In another example, increasing the dielectric constant (∈) by changing the material or materials included in the dielectric layer 310 also can increase the electric capacitance characteristic (C) of the contact assembly 110.

The electrical capacitance characteristic (C) of the contact assembly 110 may be increased by providing additional dielectric layers 310 and additional conductive layers 318. For example, a second dielectric layer that is similar to the dielectric layer 310 may be deposited onto the conductive layer 318 and a second conductive layer that is similar to the conductive layer 318 may be deposited onto the second dielectric layer. In another example, several additional dielectric layers and conductive layers may be alternatively deposited on one another to form a multi-layer structure on the conductive body 308 to form several capacitive elements integrally formed with the contact assembly 110.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §1102, sixth paragraph, unless and until such claim limitations expressly use the phrase "means for" followed by a statement of function void of further structure.

What is claimed is:

1. A contact assembly of a first connector, the contact assembly comprising:

a conductive body extending along a longitudinal axis between a mating end and a mounting end;

a first dielectric layer disposed over the conductive body between the mating end and the mounting end; and a first conductive layer disposed over the first dielectric layer and separated from the conductive body by the first dielectric layer, wherein the first conductive layer, the first dielectric layer, and the conductive body form a capacitive element, wherein the capacitive element is configured to mate with a mating contact of a second connector to establish a signal propagation path that extends from the second connector and through the first conductive layer, the first dielectric layer, and the conductive body to the first connector, and wherein the conductive body, the first dielectric layer, and the first conductive layer form a contact pin that is receivable into the mating contact of the second connector.

2. The contact assembly of claim 1, wherein the conductive body, the first dielectric layer and the first conductive layer form a capacitive filter.

3. The contact assembly of claim 1, wherein the capacitive element is in series with the signal propagation path that extends through the contact assembly.

4. The contact assembly of claim 1, further comprising a second dielectric layer and a second conductive layer, the second dielectric layer disposed adjacent to the first conductive layer and the second conductive layer disposed adjacent to the second dielectric layer, wherein the signal propagation path extends through the first and second dielectric layers, the first and second conductive layers, and the conductive body.

5. The contact assembly of claim 1, wherein the conductive body is a planar body having opposite faces, further wherein the first dielectric layer and the first conductive layer are disposed on each of the opposite faces.

6. The contact assembly of claim 5, wherein the first conductive layer on each of the opposite faces is configured to engage the mating contact of a the second connector.

7. The contact assembly of claim 1, wherein the first dielectric layer has a thickness dimension that is less than a thickness dimension of each of the first conductive layer and the conductive body.

8. The contact assembly of claim 1, wherein the conductive body is a unitary body.

9. The contact assembly of claim 1, wherein the conductive body is a stamped and formed contact.

10. The contact assembly of claim 1, wherein the signal propagation path that extends between the first and second connectors through the first conductive layer, the first dielectric layer, and the conductive body conveys data signals between the first and second connectors.

11. The contact assembly of claim 1, wherein the first conductive layer is not conductively coupled with a ground reference and the conductive body is not conductively coupled with the ground reference.

12. A contact assembly of a first connector, the contact assembly comprising:

a planar conductive body extending between opposite ends, the conductive body including opposite faces;

a first dielectric layer disposed over one or more of the faces of the conductive body; and a first conductive layer disposed over the first dielectric layer that is disposed over one or more of the faces of the conductive body, the first conductive layer separated from the conductive body by the first dielectric layer and configured to engage a mating contact of a second connector to provide a signal propagation path that extends from the second connector and through the first conductive layer, the first dielectric layer, and the conductive body to the first connector, wherein the conductive layer, the dielectric layer, and the conductive body form a capacitive element, wherein the conductive body, the first dielectric layer, and the first conductive layer form a contact pin that is receivable into the mating contact of the second connector.

13. The contact assembly of claim 12, wherein the conductive body, the first dielectric layer and the first conductive layer form a capacitive filter.

14. The contact assembly of claim 12, wherein the conductive body includes a mounting end for mounting the conductive body to at least one of a housing connector or a circuit board, further wherein the conductive body, the first dielectric layer, and the first conductive layer provide a signal propagation path between the mating contact and the at least one of the housing connector or the circuit board.

15. The contact assembly of claim 12, further wherein the capacitive element is in series with the signal propagation path.

16. The contact assembly of claim 12, further comprising a second dielectric layer and a second conductive layer, the second dielectric layer disposed adjacent to the first conductive layer and the second conductive layer disposed adjacent to the second dielectric layer, wherein the signal propagation path extends through the first and second dielectric layers, the first and second conductive layers, and the conductive body.

17. The contact assembly of claim 12, wherein the first dielectric layer has a thickness dimension that is less than a thickness dimension of each of the first conductive layer and the conductive body.

18. The contact assembly of claim 12, wherein the conductive body is a unitary body.

19. The contact assembly of claim 12, wherein the conductive body is a stamped and formed contact.

20. The contact assembly of claim 12, wherein the first dielectric layer forms a dielectric coating that substantially surrounds at least one of the ends of the conductive body.

21. The contact assembly of claim 12, wherein the signal propagation path that extends between the first and second connectors through the first conductive layer, the first dielectric layer, and the conductive body conveys data signals between the first and second connectors.

22. The contact assembly of claim 12, wherein the first conductive layer is not conductively coupled with a ground reference and the conductive body is not conductively coupled with the ground reference.

* * * * *